US006550768B2

(12) United States Patent
Jordan

(10) Patent No.: US 6,550,768 B2
(45) Date of Patent: Apr. 22, 2003

(54) SKILL BASED COIN CATCHING AMUSEMENT MACHINE

(76) Inventor: Thomas Jordan, P.O. Box 541, Oak Island, NC (US) 28465

( * ) Notice: Subject to any disclaimer, the term of this patent is extended or adjusted under 35 U.S.C. 154(b) by 0 days.

(21) Appl. No.: 09/916,057

(22) Filed: Jul. 26, 2001

(65) Prior Publication Data

US 2003/0020234 A1 Jan. 30, 2003

(51) Int. Cl.[7] ..... A63B 71/00

(52) U.S. Cl. ..... 273/138.3; 273/138.2; 273/138.4

(58) Field of Search ..... 273/138.3, 138.2, 273/138.4, 440, 446

(56) References Cited

U.S. PATENT DOCUMENTS

| | | | | | |
|---|---|---|---|---|---|
| 4,367,876 | A | * | 1/1983 | Kotoyori | 273/121 A |
| 4,496,160 | A | | 1/1985 | Wichinsky et al. | 273/369 |
| 4,588,064 | A | * | 5/1986 | Monfredi | 194/238 |
| 4,662,636 | A | * | 5/1987 | Crompton | 273/138.2 |
| 4,836,413 | A | * | 6/1989 | Monfredi | 221/270 |
| 4,840,290 | A | * | 6/1989 | Nakamura et al. | 221/10 |
| 5,120,060 | A | * | 6/1992 | Parker et al. | 273/120 A |
| 5,275,402 | A | | 1/1994 | Malavazos et al. | 273/138 A |
| 5,297,816 | A | | 3/1994 | Becchio | 273/459 |
| 5,496,030 | A | * | 3/1996 | Fernandez | 273/119 A |
| 5,501,466 | A | * | 3/1996 | Welch et al. | 273/138.3 |
| 5,507,490 | A | * | 4/1996 | Hagiwara | 273/138.3 |
| 5,566,808 | A | * | 10/1996 | Parker et al. | 194/317 |
| 5,622,366 | A | | 4/1997 | Inoue | 273/138.2 |
| 5,667,218 | A | * | 9/1997 | Kumabe et al. | 273/138.3 |
| 5,697,611 | A | * | 12/1997 | Kelly et al. | 273/126 A |
| 5,713,572 | A | * | 2/1998 | Hagiwara | 273/138.1 |
| 5,752,699 | A | * | 5/1998 | Crompton et al. | 273/138.2 |
| 5,775,691 | A | * | 7/1998 | Hamano | 273/138.2 |
| 5,785,314 | A | * | 7/1998 | Hamano | 273/138.2 |
| 5,887,870 | A | * | 3/1999 | Kumabe et al. | 273/138.1 |
| 5,899,455 | A | * | 5/1999 | Crompton | 273/138.1 |
| 5,967,515 | A | | 10/1999 | Halliburton | 273/138.2 |
| 6,092,807 | A | * | 7/2000 | Yu | 273/138.1 |
| 6,264,197 | B1 | * | 7/2001 | Halliburton | 273/138.2 |
| 6,431,542 | B1 | * | 8/2002 | Tabuchi | 273/138.3 |

* cited by examiner

*Primary Examiner*—Benjamin H. Layno
*Assistant Examiner*—Dolores R. Collins
(74) *Attorney, Agent, or Firm*—Michael E. Mauney

(57) ABSTRACT

A skill based game employing kickers to direct coins falling over the edge of a catcher plate to a player's hopper. The players deposit coins in a slot which directs the coins to a first catcher plate. Coins are pushed over the edge of this catcher plate to a second catcher plate where they are further pushed toward the edge of the second catcher plate. As coins accumulate, coins may fall over the edge of the second catcher plate. Kickers are disposed below the second catcher plate under a player's control. If a player employs the kicker correctly, the coins falling over the edge of the second catcher plate are directed to a player's hopper. If the player fails to employ the kickers correctly, coins fall into a hopper and are retained by the operator of the machine.

11 Claims, 5 Drawing Sheets

SKILL BASED COIN CATCHING AMUSEMENT MACHINE

FIELD OF THE INVENTION

This invention relates generally to coin or token operated amusement device and more particularly to a skill based variation of the amusement game commonly called a coin pusher. In a coin pusher game, a player deposits a coin or token on a surface of a game board. On one side of the game board is a moving pusher device, which periodically sweeps or pushes coins or tokens off a predetermined portion of the board. Opposite from the pusher on the game board is an edge leading to a pay-off hopper. If coins are pushed by the pusher over the edge, the coins are collected in a hopper which determines a pay-off or reward to a player.

BACKGROUND OF THE INVENTION

Coin pusher games are widely distributed where they are legal. In one variation of a coin pusher game, there is a level polished game board usually made of metal. An accumulation of coins will be placed on the level game board by the operator. The amount of coins necessary varies depending on the size of the game board and the mechanisms employed, but typically will be known to the operator. On one side of the game board, there is an edge. Coins that fall off or over the edge are typically collected in a hopper and paid to the player. Opposite from the edge is a mechanically operated sweeper or pusher device that sweeps a predetermined fixed area of the game board by pushing anything lodged in that portion of the game board toward the drop-off edge. If enough coins have accumulated on the level game board, it will appear that a large number of coins are unstably poised on the edge and ready to fall and provide a handsome reward to a player. This tempts a player to deposit a coin into the game. Typically, it falls in the area of the game board swept by the pusher. Most games allow a player to "aim" the fall of the coin by allowing some player control over a coin guide. This introduces some level of skill in the game. However, the element of skill is not complete. The coin may fall to the game board on its edge hence, can roll on the game board rather than stopping at the place to which the player may wish to direct it by manipulation of the coin guide.

Theoretically, if enough coins collect on the playing area, then the addition of a further coin will cause one coin to fall off. Once this stage in which the game board is fully "loaded", the game becomes a zero sum game in which the addition of a coin should cause, theoretically, a coin to be returned to the player. Of course, in practice, randomness enters into the equation so that some players may add one coin and collect ten, while other may add ten to collect one. But in the long run, this type of game, once the board is "fully loaded", is a zero sum game in which the skill of the player in analyzing the board, determining where coins are most likely to fall off, then correspondingly directing the use of the coin chute to more effectively place new coins on the game board so as to cause accumulated coins to fall over the edge rewards a skillful player at the expense of the less skillful.

However, most coin pusher devices have slots cut into the side walls of the gane board. These will ordinarily be concealed by a mirror or in some other unintrusive fashion, so that a casual player will not notice these slots. Coins falling through these slots will not be returned to the player, but to the house or game operator. Consequently, games that have these slots cut in the side will have a set house percentage of the play. This turns this from a zero sum game into a gambling game where, in the long run, a skillful player is bound to lose because of the house percentage. Rules and laws governing the operation of games vary widely from local jurisdiction to local jurisdiction within the United States. Even within a particular jurisdiction, rules may vary in special venues, such as Indian reservations, on casino cruise ships, and the like. Many jurisdictions, which will allow a "skill based" game that does not have a set house percentage, prohibit as unlawful the standard coin pusher game which has side slots for return of coins to the house.

The standard coin pusher game has limited skill and limited interest to a player. Consequently, the standard coin pusher game does not support the kind of play that a video poker game or a slot machine supports in which a player may stay at one machine and play for an extended period of time. More typically, in a coin pusher game, a player drops a few coins into the pusher to "try" his luck and quickly moves on to another game. For these reasons, a variety of expedients have been proposed to make coin pusher games both more interesting and more skillful. For example, Malavazos et al., U.S. Pat. No. 5,275,402, proposes a game board with a variety of holes through which coins may drop, as well as the standard edges. Here, the coin pusher is disposed on the game board but is generally cylindrical and rotates about an axis. A player may attempt to use a coin chute to aim coins into the holes or to roll coins in such a fashion as to knock other coins off the edge. This invention provides for more than one player to play the game at one time by having multiple coin chutes. Another variation of the coin pusher game is seen in Bechio, U.S. Pat. No. 5,297,816. Here, there are a variety of cylindrical-like game surfaces arranged above each other and spaced apart. A player drops a coin on the top surface, which may cause coins to fall on the cylindrical surface below it, which then causes coins to fall on the cylindrical surface below it, which then causes coins to fall on a cylindrical surface below it, where they may be finally pushed off the edge and into the player's hopper. Because of the various surfaces involved, it allows a variety of different pusher designs with the added interest in which one coin falling off the first surface might cause five coins to fall off the second surface, which might cause twenty coins to fall off the third surface, and so on. Crompton et al., U.S. Pat. No. 5,752,699, discloses a variation of the coin pusher in which the coins themselves do not return to the player by means of a hopper, but rather are counted by a counting device based on the amount of coins a prize is determined which may be paid out to the player. Hagiwara, U.S. Pat. No. 5,713,572, provides a pusher game apparatus in which the stroke of the pusher may be varied based on whether a coin trips a "jackpot" device. If it trips a jackpot device, the pusher may be directed to sweep a greater area, thus substantially increasing the likelihood of coins falling off the edge hence, the pay-out to the player. Crompton, U.S. Pat. No. 5,899,455, proposes a coin pusher device with a hopper. Playing pieces deposited by a player may be held in the hopper, rather than dropped to a playing field. Once a sufficient number of playing pieces are in the hopper, the hopper will release them to the playing field, again, greatly increasing the likelihood of a large pay-out to a player giving a jackpot-like effect. Halliburton, U.S. Pat. No. 5,967,515, proposes a series of targets like train cars or dump truck beds. A player attempts to direct a coin by the coin track to land it in a particular dump truck bed or train car, which may cause all the coins accumulated in that receptacle to be paid to the player.

Despite these efforts there is still room for improvement in the broad field of coin pusher amusement devices. More specifically, there is room for a device which, if played properly, can be a game in which the house will have no preset or predetermined winning percentage. This type of game will be allowable in many jurisdictions where a standard coin pusher game with house side slots will not be allowed. In this type of game, there will be a standard horizontal playing field with at least one pusher. In variations of the game, there may be more than one playing field and more than one pusher in which a coin will first land on an upper horizontal field. Coins in this field will be swept by a pusher to a second lower field where a pusher will further sweep the coins and so on to where, after a multiple number of fields, there will be an edge where coins will fall either to be returned to a player or to the house. In this game, the player can control the coin guide through which a coin is deposited and hence, falls onto the playing field. This provides an initial level of skill, albeit with a good deal of randomness, that allows a player to attempt to deposit the coin into a particular area. When the coin is on the playing field, the pusher will move it toward the edge where it may cause other coins to fall, as with known pusher devices. There is skill involved in directing the coin into the appropriate area of the pusher field so that it will maximize the chances of coins falling off the edge. However, here, when coins begin to fall off the edge, the player must employ a player controlled chute or kicker, which diverts the coins into the player's receptacle. A plurality of kickers may be employed, each of which covers a portion of the playing field edge. Hence, if a player employs the wrong kicker, he may fail to catch coins falling off the edge. Coins falling off the edge, which are not caught in the player's kicker and directed to the player's hopper, are not paid to the player or, at least, are not used in determining the player's pay-out. Consequently, there is skill involved in not only directing a coin through the use of the coin guide to a particular area of the pusher field to increase the likelihood of coins falling off the edge, but also skill is required in determining where coins are most likely to fall off the edge. By anticipating where coins are likely to fall off the edge, the player can then correctly deploy the appropriate kicker to catch coins falling off the edge. Hence, concentration and reflexes also come into play in this game. Once the pusher field is completely loaded, a skillful player theoretically will be able to recover every coin which is deposited. Because earlier players may not have been so skillful or patient, a more skillful player than the average player may consistently win more than less skillful players. If all players are of equal skill and play the game at the ideal skill level, then the game can be a zero sum game with no guaranteed house percentage. Because there is no guaranteed house percentage, in many jurisdictions, this type of game will not be considered a gambling game and may be permitted where a standard pusher game with side house slots would not be permitted.

DETAILED DESCRIPTION OF THE DRAWINGS

Figure 1:
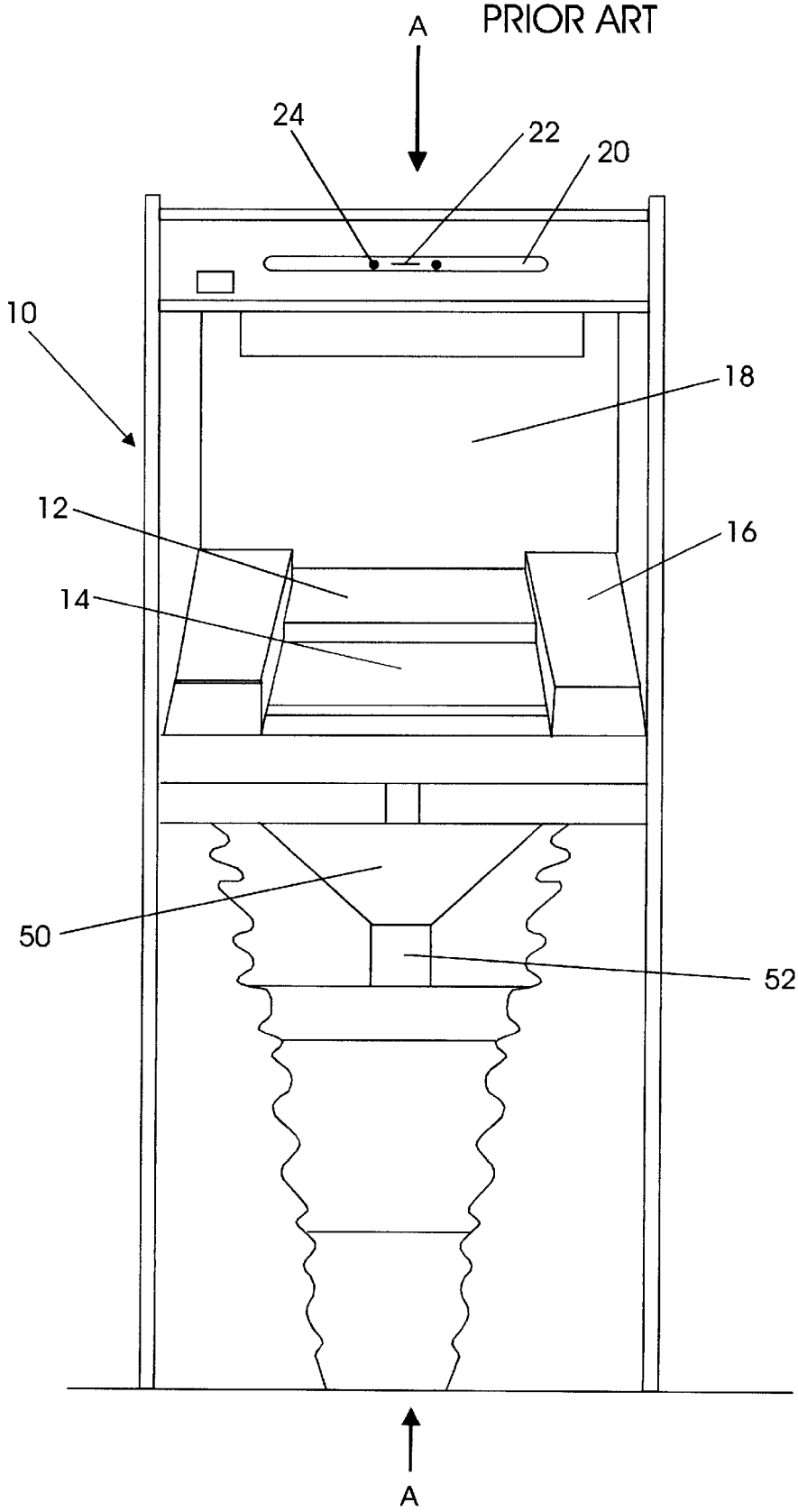
FIG. 1 PRIOR ART
FIG. 1 shows a prior art game seen from the front and FIG. 1A shows the a cut-a-way side view along lines A—A in FIG. 1 of the prior art game.

The prior art coin pusher (10) is seen from the front in FIG. 1. A portion of the lower part of the prior art coin pusher (10) is cut-a-way for better visual location of the hopper (50) and hopper basin (52). At the top of FIG. 1 is a coin slot mechanism (20) with a coin slot (22) and slide handles (24). The coin slot mechanism (20) allows the coin slot (22) to be moved from side to side by the handles (24). This gives a user the ability to direct a coin deposited in the coin slot (22) to a particular part of the first catcher plate (12). The first catcher plate (12) moves in a direct reciprocating motion powered by the motor (30) (seen in FIG. 1A). The second catcher plate (14) is fixed. The first catcher plate (12) moves back and forth alternately covering and exposing a portion of the second plate (14). A back wall (18) descends vertically to form an approximate perpendicular angle with the surface of the first catcher plate (12). As a coin is deposited in the coin slot (22), it falls by force of gravity onto the first catcher plate (12). It is desirable for a player that the coin deposited in the coin slot (22) land on an empty area of the first catcher plate (12). In practice, when the game is set up, the owner or operator of the game will place a large-number of coins on both the first and second catcher plates (12, 14) so that a portion of them will be leaning over the edges of the first and second catcher plates apparently ready to fall into the hopper (50). If a player succeeds in depositing a coin through the coin slot mechanism (20) using the coin slot (22) onto an empty area of the first catcher plate (12), then as the catcher plate motor (30) pulls the first catcher plate (12) backward toward the motor (30) exposing more of the second catcher plate (14), then the back wall (18) will contact the coin that has fallen on the first catcher plate (12) and push it forward increasing the crowding of coins already present on the first catcher plate (12). This means that coins may fall over the edge of the first catcher plate (12) onto the surface of the second catcher plate (14). These coins will fall into a then unoccupied area of the second catcher plate (14) since the fall is most likely to occur at or near the furtherest withdrawal of the first catcher plate (12) from the surface of the second catcher plate (14). As these coins fall on the second catcher plate (14), the motor (30) now will begin to move the first catcher plate (12) forward. Because the surface of the first catcher plate (12) is flush with the surface of the second catcher plate (14), the coins that have fallen over the edge of the first catcher plate (12) will be pushed forward by the movement of the first catcher plate (12) increasing the crowding in the second catcher plate (14) and increasing the likelihood that coins will fall over the edge of the second catcher plate (14). The face plate of the prior art coin pusher (10) is shown in partial cut-a-way to better show the hopper (50) and the hopper basin (52). Once the coins fall over the edge of the second catcher plate (14), they fall by gravity into a hopper (50) to accumulate in the hopper basin (52). The hopper basin (52) is accessible to players to retrieve the coins that have fallen. Most prior art coin pusher games have slots cut into the side wall (16). These are not shown in FIG. 1 or FIG. 1A. Coins that fall into the side slots (not shown) in the side wall (16) will be paid to the house while all coins falling over the edge of the second catcher plate (14) are directed by the hopper (50) to the hopper basin (52). The coins falling through the side slots (not shown) are ones that are paid to the house for the house percentage.

Figure 1A:
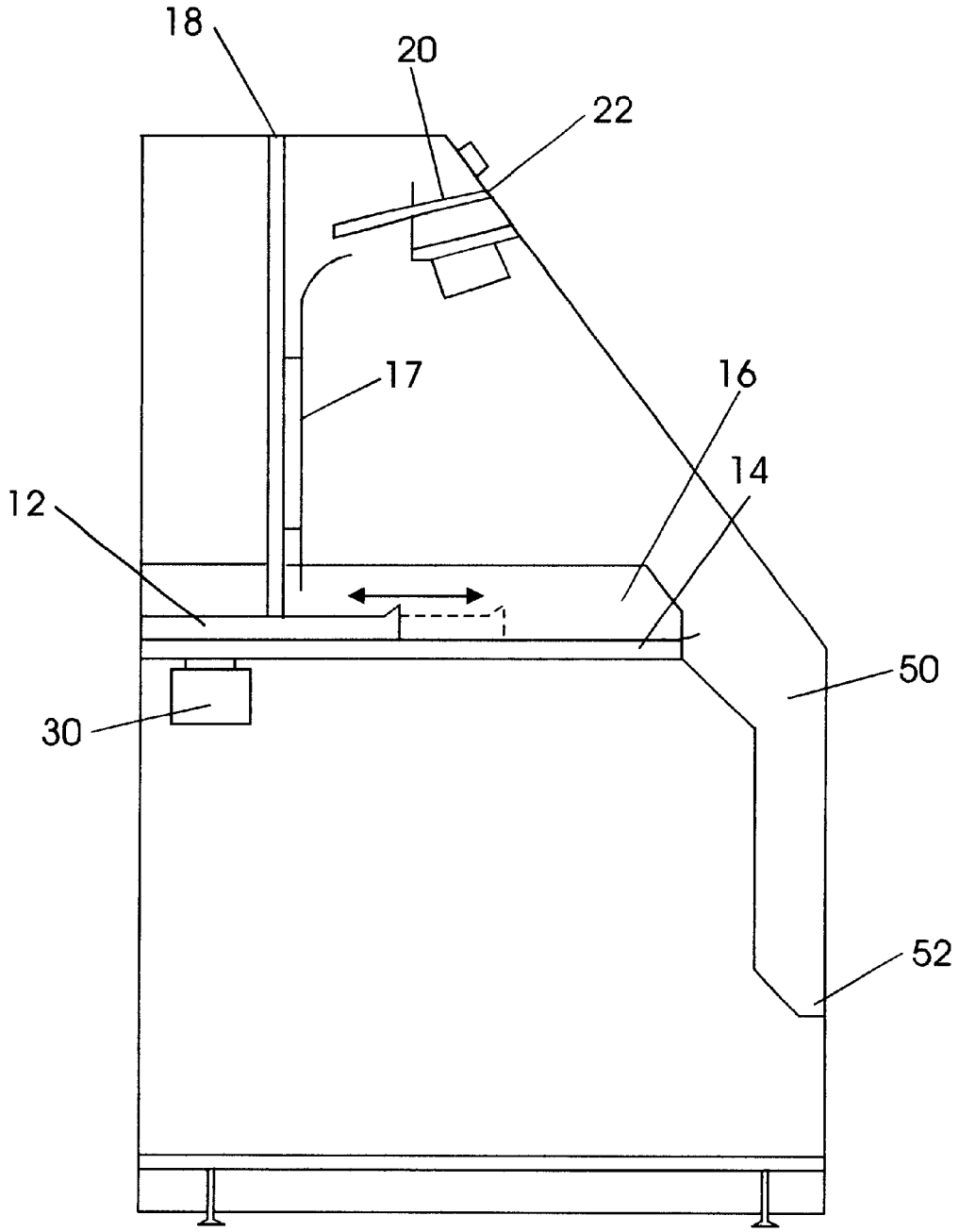
FIG. 1A PRIOR ART

FIG. 1A shows a cut-a-way view of the prior art coin pusher (10) along lines A—A in FIG. 1. Coins are deposited in the coin slot mechanism (20) through the slot (22) to fall into the first catcher plate (12). Usually there is a deflection mechanism (17) to direct the falling coins to the back of the first catcher plate (12). The motor (30) moves the catcher plate (12) back and forth in the direction shown by the arrow.

The first catcher plate (12) is shown in solid lines in a fully withdrawn position and in dotted lines in the fully extended position. A coin coming through the coin slot mechanism (20) will ordinarily fall onto the first catcher plate (12). As the first catcher plate (12) fully withdraws to the position shown in the solid lines, this will increase crowding on the first catcher plate (12) possibly causing one or more coins to fall off the first catcher plate (12) onto the second catcher plate (14). As the motor (30) causes the first catcher plate (12) to move fully forward to the position shown in the dotted lines, the coins that have recently fallen onto the second catcher plate (14) will increase the crowding for the coins that are already present on the second catcher plate (14), thus increasing the likelihood that some will fall off the front edge of the first catcher plate (14) to be collected by the hopper (50) and directed to the hopper basin (52) as earlier explained for FIG. 1. In some prior art coin pushers (10), there will be slots (not shown) cut into the side wall (16). This will relieve some of the crowding on the first catcher plate (14) as coins are pushed into the side slots (not shown) on the side plate (16). If the prior art coin pusher (10) has such side slots (not shown), the coins falling through the side slots (not shown) will go to the house as the house percentage.

For a prior art coin pusher (10) without side slots, there would be little, if any, reason for an operator to place such a game in play since the operator must first furnish a sufficient number of coins on the first and second catcher plates so that it will appear likely to a user that addition of further coins will cause coins to fall over the edge to accumulate in the catcher basin (52). While people may have unreasonable hopes about the return of the game, they are not stupid and they will not place a coin into a slot unless there appears to be some reasonable chance they will recover at least the coin they have placed in the slot and most will be hopeful they will recover substantially more coins than they placed into the slot Moreover, simply placing the machine into play will require floor space, power to operate the catcher motor and lights, and there would be little, if any, reason to place it in place unless there is some return for the owner for operating expenses and profit. In some circumstances, simply having the game to attract foot traffic to an area may be enough to place the machine in use without any further return to the operator. Once the first and second plates become "fully loaded", then the addition of further coins would ordinarily result in a Like number of coins on the average falling into the hopper basin (52). In practice, the coin pusher operator will use slots (not shown) cut into the sidewall (16). These slots will be significantly smaller than the front edge of the second catcher plate (14), but will be large enough to where occasionally coins will fall through those slots. Coins falling through the side slots (not shown) will be retained by the owner as compensation for having the machine in place and in use. However, the use of these side slots (not shown), depending on their location and size, assure that a certain number of coins deposited will go to the house and not to the player. This house percentage to the owner makes this a gambling device illegal in many jurisdiction. Consequently, for regulatory reasons, coin pushers with side slots are limited in jurisdictions where they are allowed. It is an object of this invention to avoid the need for an owner to place side slots in a coin catcher while at the same time making it possible for the owner to recover a reasonable return for his expense in placing the machine in a business establishment and paying for its operation.

Figure 2:
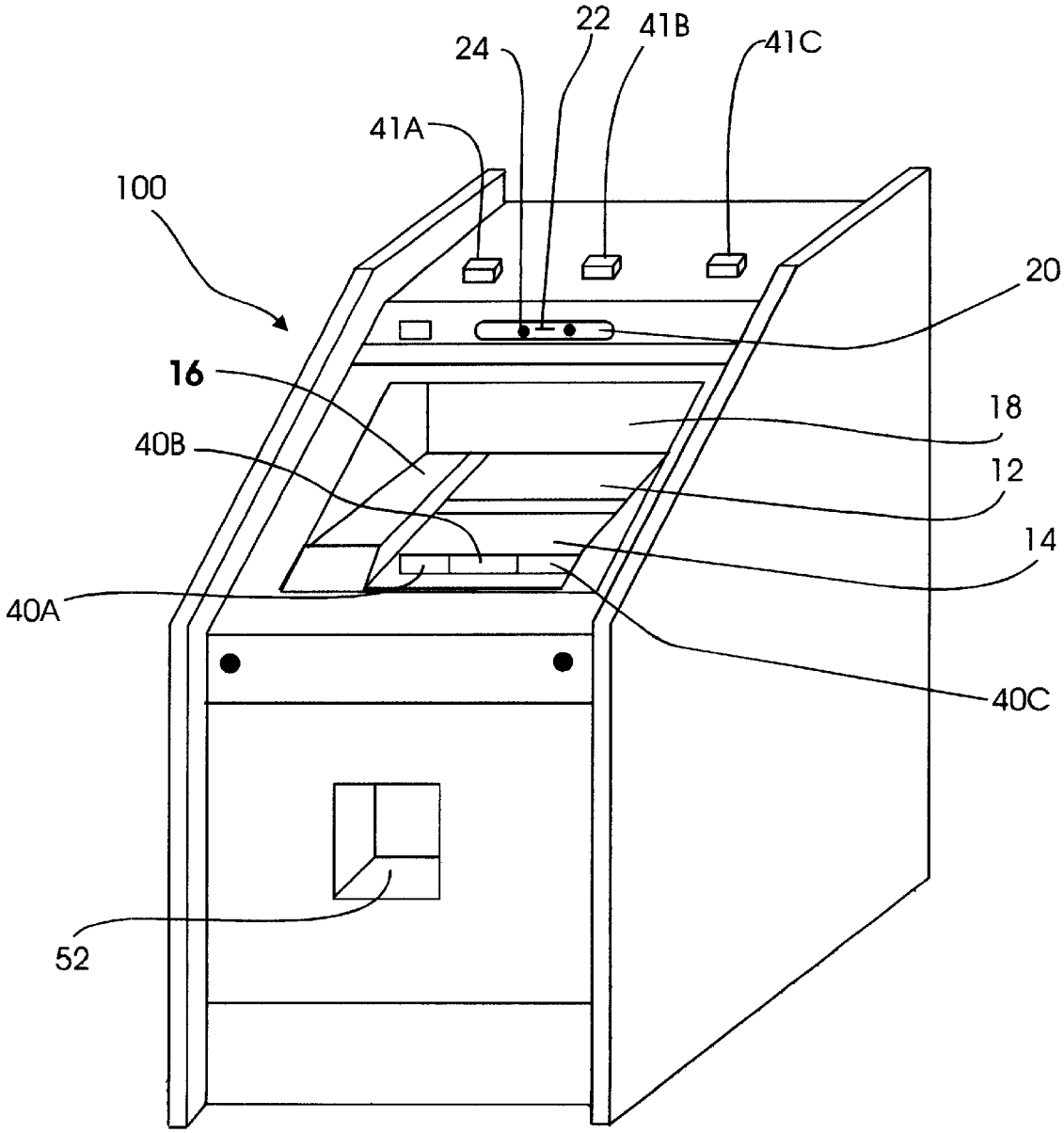
FIG. 2 is a prospective view of the current invention.

FIG. 2 shows in prospective view the skill coin pusher (100) seen from the front There is a coin slot mechanism (20) with a coin slot (22) and slide handles (24). The coin slot mechanism (20) allows the coin slot (22) to be moved from side-to-side by the handles (24). A user may direct a coin deposited in the coin slot mechanism (20) through the coin slot (22) to a particular part of the first catcher plate (12) by means of the slide handles (24). The first catcher plate (12) moves in a direct reciprocating motion powered by the motor (30) seen in FIG. 2A. The second catcher plate (14) is fixed. The first catcher plate (12) moves back and forth alternately covering and exposing a portion of the second catcher plate (14). A back wall (18) descends vertically to form an approximate perpendicular angle with the surface of the first catcher plate (12). As a coin is deposited in the coin slot mechanism (20), it individually falls onto the first catcher plate (12). The coin is swept forward by the motion of the first catcher plate (12) and the back wall (18), possibly resulting in one or more coins falling off the edge of the first catcher plate (12) and onto the second catcher plate (14). As the first catcher plate (12) moves forward, it again crowds the newly fallen coins on the second catcher plate (14), forcing them toward the edge of the second catcher plate (14). One or more coins may fall over the edge of the second catcher plate (14). Disposed below the second catcher plate (14) are kickers (40A, 40B, and 40C). These are controlled respectively by buttons (41A, 41B, and 41C). As a coin falls off the left edge of the second catcher plate (14), if a player depresses button (41A) it activates kicker (40A) forcing it outward where it will be positioned below the portion of the second catcher plate (14) in which the coins are poised to fall. Each kicker (40A, 40B, and 40C) operate similarly using the appropriate button (41A, 41B, and 41C). If a player activates the kicker below the portion of the edge of the second catcher plate (14), at an appropriate lime the coins falling over the edge of the second catcher plate (14) will be directed by the kicker to the basin (52) where they will be retrieved by the successful player.

It will be readily appreciated by one of skill in the art in reviewing FIG. 2 that the prior art coin pusher machine shown in FIGS. 1 and 1A can be retrofitted with the kickers (40A, 40B, and 40C) and buttons (41A, 41B, and 41C). Consequently, this invention can be employed in a coin pusher machine or separately sold as a retrofit unit to go on a prior art coin pusher machine to equip it to play a skill based game while employing many of the mechanisms found in standard coin pusher machines.

Figure 2A:
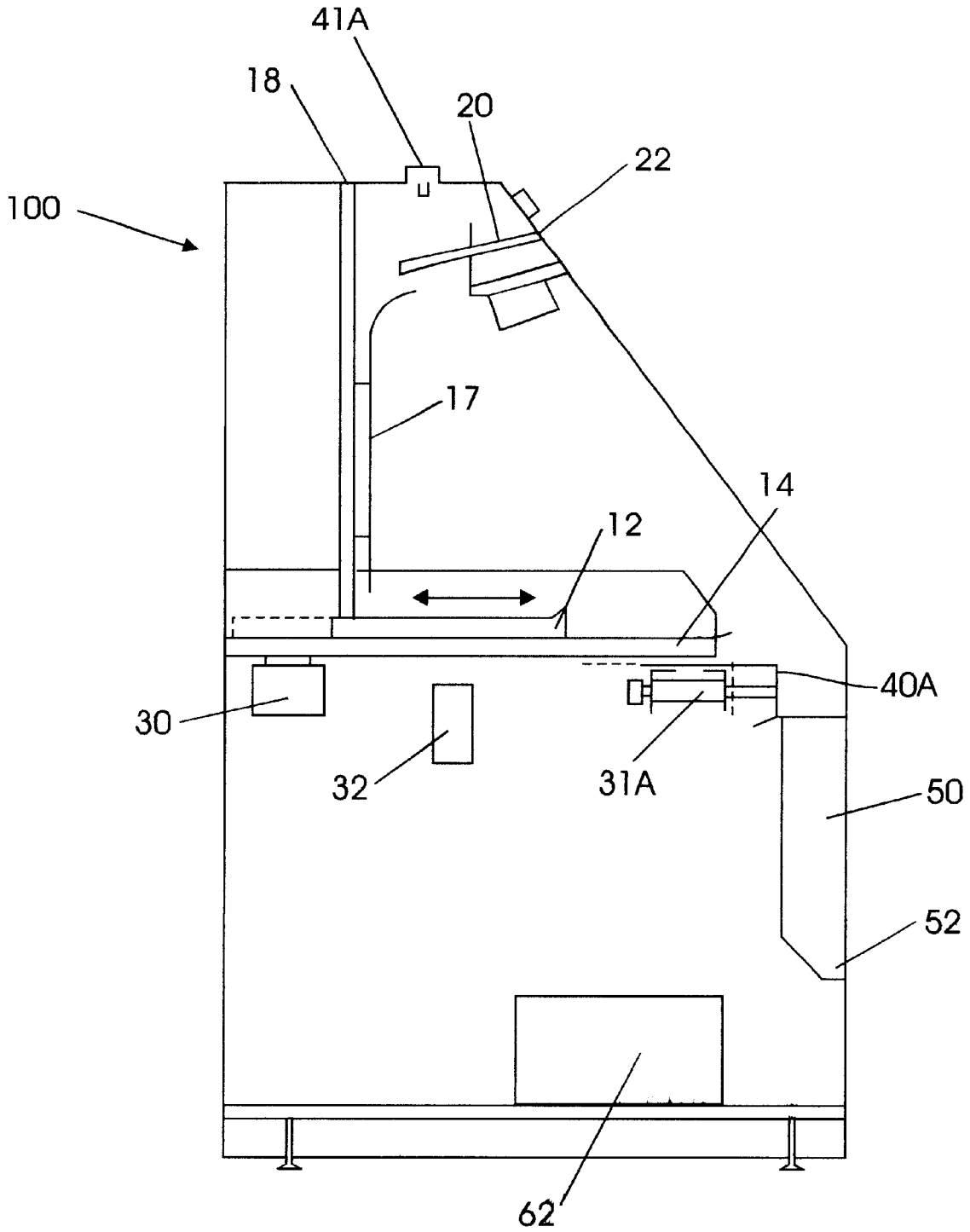
FIG. 2A is a side cut-a-way of the current invention.

FIG. 2A shows in a cut-a-way side view the skill coin pusher (100) in action. A coin will be deposited in the coin slot mechanism (20) through the slot (22) where it will be directed by the deflection mechanism (17) onto the first catcher plate (12). The motor (30) causes the first catcher plate (12) to move back and forth, as is shown by the arrow in FIG. 2A. As the first catcher plate (12) moves to the position shown in the dotted lines, the coin which has just fallen onto the first catcher plate (12) will be pushed by the back wall (18) toward the front of the first catcher plate (12). This coin may cause one or more coins to fall off the front of the first catcher plate (12) when it is in the withdrawn position shown in the dotted lines. These coins will then fall onto the second catcher plate (14). Typically, they will fall into an area covered by the first catcher plate (12) in its reciprocating motion. As the first catcher plate (12) begins to move forward, it will push these newly fallen coins forward on the second catcher plate (14) toward the edge of the second catcher plate (14). This motion will increase the crowding of coins already on the second catcher plate (14) and increase the likelihood that coins will fall off the front edge of the second catcher plate (14). If the appropriate kicker (40A, 40B, and 40C) is extended beneath the portion of the front edge of the second catcher plate (14), the coins will fall onto the kicker and likely be directed into the hopper (50) to the player's basin (52). Shown in FIG. 2A, the kicker (40A) is powered by the motor (31A) to extend forward beneath the front edge of the second catcher plate (14) and extending outward to the hopper (50). The motor (31A) is activated by the button (41A) through the kicker control (32) and is under the control of the player. However, if a player fails to activate the appropriate kicker, then coins falling off the front edge of the second catcher plate (14) will fall into the house basin (62). The kickers (40B and 40C) (not shown) are respectively controlled by motors (31B and 31C) (not shown). They are activated by the kicker control (32) and the buttons (41B and 41C) (not shown). The discussion of the buttons (41A, 41B, and 41C), the motors (31A, 31B, and 31C), the kickers (40A, 40B, and 40C), and the kicker control (32) are discussed in more detail in FIG. 3.

Figure 3:
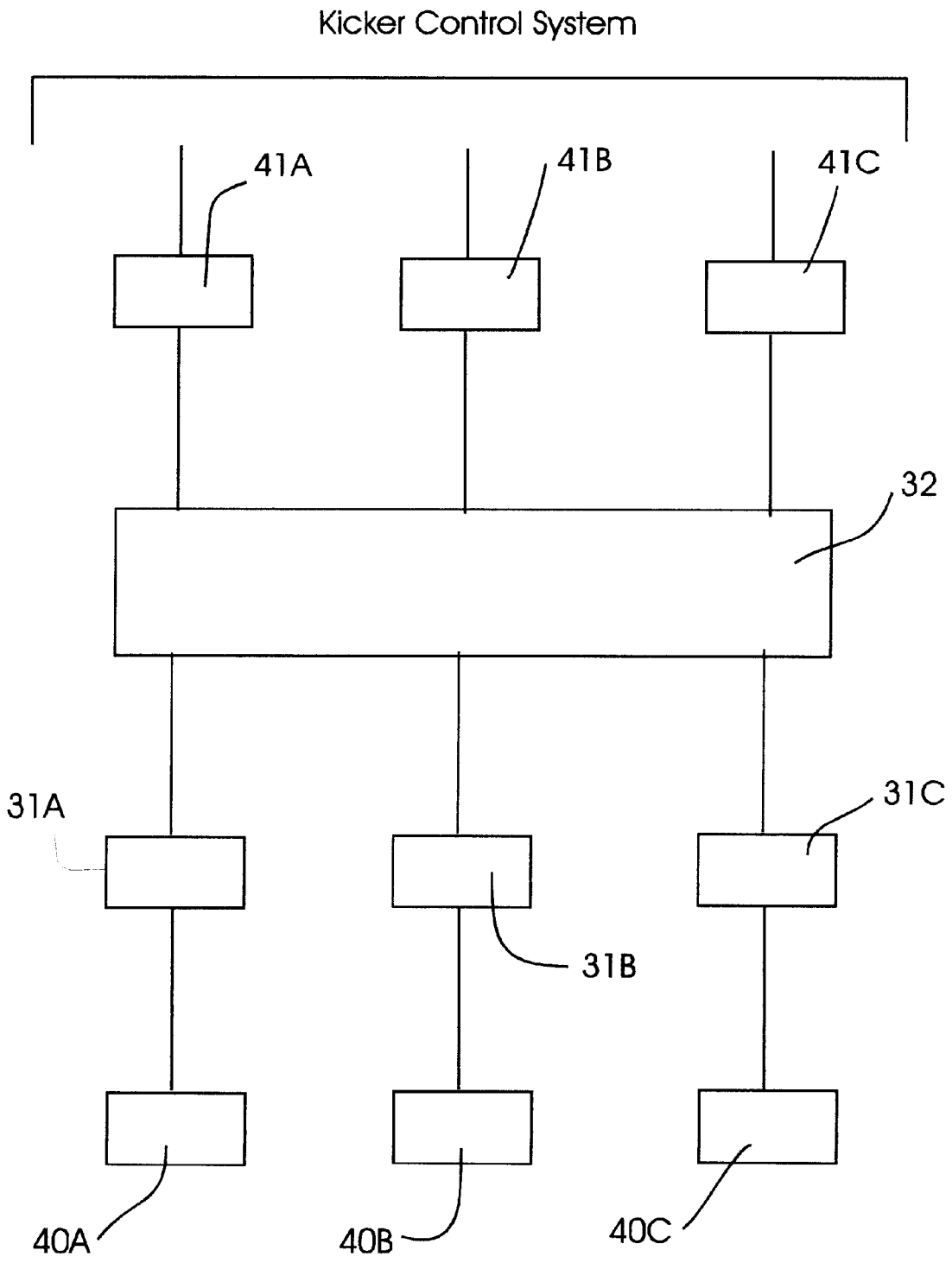
FIG. 3 is a block diagram of the kicker controls.

FIG. 3 is a block diagram illustrating the operation of the control system for three kickers (40A, 40B and 40C). It will appreciated that more than three kickers could be employed or less than three kickers could be employed. It will also be appreciated that a variety of means are available for controlling the kickers. The kickers are controlled by buttons (41A, 41B, and 41C). These are operatively connected to the kicker control (32). This connection could be by electrical wires, radio waves, infrared, or other wireless means of communication. In an example of a control system for the kickers, depositing a coin into the coin slot (22) momentarily closes a common leaf switch. Closure of the switch activates a start/stop timer for 40 seconds. Each coin deposited restarts the timer. When the timer is active 24 volts of direct current are supplied to solenoids for the kickers. If a kicker switch is depressed it will activate the kicker. One type of kicker switch is a single pole double throw monetary cherry snap switch. Ground is supplied through the kicker switch to the corresponding kicker solenoid. Ground is supplied from the common tab of the left kicker switch. The ground path is continued through the normally closed tab to the common tab of the center kicker switch and from the normally closed tab to the common tab of the right kicker switch where it is terminated. Ground is supplied to the kicker solenoids through the normally open tab of the corresponding kicker switch. Thus when the left kicker switch is activated, the right and center switches become inactive and so on. In this fashion no more than one kicker switch at any time can be activated and no more than one kicker at any time can be extended.

It is anticipated in a commercial embodiment of this invention a wide variety of control options will be available through the kicker control (32) to the operator of the game. First, this will enable the operator to control operation of the kickers to conform with disparate regulatory environments in which the skill based coin pusher (100) might be placed for commercial use. Moreover, even within one regulatory environment, some types of kicker control system schemes might be more popular in one venue than in another. For example, if the skill based coin pusher (100) is to be placed in a venue where the majority of players are youthful, then the kicker control system could be employed to emphasize reflexes over strategy. If, on the other hand, the skill based coin pusher (100) is to be placed in a venue where the majority of users may be older or of retirement age, then the kicker control system could be devised to emphasize strategy over quick reflexes.

Among other variations, the game may be set up so that no more than one kicker or two kickers can be operated simultaneously. Moreover, the kickers may be set up to where there is an increased or decreased likelihood of coins that fall onto the kicker will be directed to the player's basin (52) or the house hopper (60). The kickers (40A, 40B, 40C) may operate on a time cycle where they will only be extended for a certain period of time after the button is depressed. The surface of the kickers (40A, 40B, 40C) can be slanted to increase the likelihood of a coin falling into a player's basin (52) or to decrease the likelihood of a coin falling into a player's basin (52). For example, if the kickers (40A, 40B, 40C) are slanted toward the player's basin (52), it may be desirable on the part of the owner to make it impossible for a player to operate more than one kicker at a time or make the interval that the button extends the kicker forward to a position favoring a player is limited in time. The element of skill employed by a player will be (1) to determine where coins are most likely to fall off; and (2) to determine the timing of when coins are likely to fall off so as to employ the correct kicker or kickers at the correct time to increase the likelihood the kickers will cause the coins to fall into the player's hopper, as opposed to the house hopper. There is skill involved in directing where the coins fall initially by use of the coin slot (22). There is skill involved in determining where coins are most likely to be swept from the first catcher plate (12) onto the second catcher plate (14) and from the second catcher plate (14) to fall over the edge of the second catcher plate (14). There is skill involved in timing the kicker buttons (41A, 41B, 41C) to control the kickers (40A, 40B, 40C) to kick the coins falling over the edge of the second catcher plate (14) into the player's basin (52).

I claim:

1. A coin pusher machine comprising:

(a) means for depositing a coin on at least one surface;

(b) means for randomly pushing coins deposited on said surface toward a first edge of said surface;

(c) at least one kicker disposed below said first edge of said surface, said kicker operatively controlled by a player/whereby a player may direct coins falling over said first edge of said surface to a player basin whereby a player may collect said coins;

(d) means for collecting coins fallen over said first edge of said surface where a player has failed to operate said kicker to direct coins falling over said first edge to said player basin.

2. A coin pusher machine of claim 1 wherein there are a plurality of kickers disposed below said first edge of said surface.

3. A coin pusher machine of claim 2 wherein for each individual kicker in said plurality of kickers, said individual kicker is disposed below only a predetermined portion of said first edge of said surface.

4. A coin pusher machine of claim 3 wherein said plurality of kickers is disposed below the entire dimension of said first edge of said surface.

5. A coin pusher machine of claim 4 wherein coin pusher machine further comprises means for varying operation of said kicker control whereby activation of said kicker control will activate said kicker in a predetermined fashion determined by said means for varying.

6. A coin pusher machine of claim 5 wherein for each individual kicker in said plurality of kickers, said individual kicker is operatively connected to an individual kicker control whereby when a player activates an individual kicker control, said kicker operatively connected to said individual kicker control extends from below said first edge of said surface whereby coins falling off of said first edge of said surface will be directly by said individual kicker to said player basin.

7. A coin pusher machine of claim 6 wherein said plurality of kicker further comprises three individual kickers operatively connected to three individual kicker controls.

8. A kicker device to fit on an existing coin pusher machine comprising:

(a) at least one kicker disposed below an edge of a surface in an existing coin pusher machine;

(b) at least one player operated kicker control connected to said kicker whereby a player may direct operation of said kicker to increase the likelihood of directing coins falling over an edge of said existing coin pusher machine to be collected in a predetermined location;

(c) means for mounting said kicker and said kicker control to an existing coin pusher machine.

9. A kicker device to fit on an existing coin pusher machine of claim 8 wherein there are pluralities of kickers.

10. A kicker device to fit on an existing coin pusher machine of claim 9 wherein for each individual kicker in said plurality of kickers said individual kickers, is disposed below a predetermined portion of an edge of an existing coin pusher machine.

11. A kicker device to fit on an existing coin pusher machine further comprising means for varying operation of said player operated kicker control whereby activation of said player operated kicker control will cause said kicker to move in a predetermined fashion determined by said means for varying.

* * * * *